US010655845B2

(12) United States Patent
Acosta Herrero et al.

(10) Patent No.: US 10,655,845 B2
(45) Date of Patent: May 19, 2020

(54) GAS BURNER AND GAS COOKTOP

(71) Applicant: BSH Hausgeräte GmbH, Munich (DE)

(72) Inventors: Luis Acosta Herrero, Maliaño (ES); Javier Corral Ricalde, Muriedas (ES); Melca Gutierrez Humara, La Penilla (ES); Pedro Herrera Estrada, Santander (ES); Alberto Lopez Ortiz, Santander (ES); Jose Salvador Ochoa Torres, El Astillero (ES); Luis Antonio Palacios Valdueza, Astillero (ES); Emilio Placer Maruri, Liencres (ES)

(73) Assignee: BSH Hausgeräte GmbH, Munich (DE)

( * ) Notice: Subject to any disclaimer, the term of this patent is extended or adjusted under 35 U.S.C. 154(b) by 163 days.

(21) Appl. No.: 15/559,084

(22) PCT Filed: Mar. 3, 2016

(86) PCT No.: PCT/IB2016/051199

§ 371 (c)(1),
(2) Date: Sep. 18, 2017

(87) PCT Pub. No.: WO2016/157006

PCT Pub. Date: Oct. 6, 2016

(65) Prior Publication Data

US 2018/0073730 A1 Mar. 15, 2018

(30) Foreign Application Priority Data

Mar. 31, 2015 (ES) ..... 201530438

(51) Int. Cl.

| | |
|---|---|
| ***F23D 14/06*** | (2006.01) |
| ***F24C 3/08*** | (2006.01) |
| ***F24C 3/10*** | (2006.01) |

(52) U.S. Cl.

CPC ..... *F23D 14/06* (2013.01); *F24C 3/085* (2013.01); *F24C 3/103* (2013.01); *F23D 2207/00* (2013.01)

(58) Field of Classification Search

CPC .. F24C 3/085; F24C 3/103; F24C 3/08; F23D 14/06; F23D 2207/00

See application file for complete search history.

(56) References Cited

U.S. PATENT DOCUMENTS

| | | | | |
|---|---|---|---|---|
| 5,653,219 | A * | 8/1997 | Taplan | F24C 3/085 126/39 H |
| 6,328,556 | B1 | 12/2001 | Soemer | |
| 2010/0279238 | A1 | 11/2010 | Harneit | |

FOREIGN PATENT DOCUMENTS

| | | | |
|---|---|---|---|
| EP | 0964203 | A1 | 12/1999 |
| EP | 2267371 | A2 | 12/2010 |

(Continued)

OTHER PUBLICATIONS

International Search Report PCT/IB2016/051199 dated Apr. 29, 2016.

*Primary Examiner* — Alfred Basichas

(74) *Attorney, Agent, or Firm* — Michael E. Tschupp; Andre Pallapies; Brandon G. Braun

(57) ABSTRACT

A gas burner for a gas cooktop includes a burner lower part, which can be arranged below a cooktop plate of the gas cooktop, a burner upper part, which can be arranged above the cooktop plate and is connected to the burner lower part, and a thermocouple and/or an igniting element, which is simultaneously received in a receiving section of the burner lower part and an receiving section of the burner upper part.

15 Claims, 6 Drawing Sheets

(56) References Cited

FOREIGN PATENT DOCUMENTS

| | | | |
|---|---|---|---|
| EP | 2439449 | A1 | 4/2012 |
| GB | 2083187 | A | 3/1982 |
| WO | 03058126 | A1 | 7/2003 |
| WO | 2015113619 | A1 | 8/2015 |

* cited by examiner

GAS BURNER AND GAS COOKTOP

CROSS-REFERENCES TO RELATED APPLICATIONS

This application is the U.S. National Stage of International Application No. PCT/IB2016/051199, filed Mar. 3, 2016, which designated the United States and has been published as International Publication No. WO 2016/157006 A1 and which claims the priority of Spanish Patent Application, Serial No. P201530438, filed Mar. 31, 2015, pursuant to 35 U.S.C. 119(a)-(d).

BACKGROUND OF THE INVENTION

The present invention relates to a gas burner and a gas cooktop.

A gas burner can have a burner lower part, a burner upper part connected to the burner lower part and a burner lid placed on the burner upper part. For monitoring the flame and for ignition, the gas burner may comprise a thermocouple and an igniting element. The igniting element and the thermocouple may be fastened to the burner lower part with the aid of fastening means such as fastening tabs or spring elements. EP 2 439 449 A1 describes a gas burner of this kind.

BRIEF SUMMARY OF THE INVENTION

Against this background an object of the present invention consists in making available an improved gas burner.

Accordingly, a gas burner for a gas cooktop is proposed. The gas burner comprises a burner lower part, which can be arranged below a cooktop plate of the gas cooktop, a burner upper part, which can be arranged above the cooktop plate and which is connected to the burner lower part, and a thermocouple and/or an igniting element, which is simultaneously received in a receiving section of the burner lower part and a receiving section of the burner upper part.

As a result of the thermocouple and/or the igniting element simultaneously being received in the burner lower part and the burner upper part, it is possible to dispense with additional fastening elements. This sandwich construction allows the thermocouple and/or the igniting element to be fixed permanently and reliably in the provided position.

According to one embodiment, a fastening section of the thermocouple and/or of the igniting element is arranged between the burner lower part and the burner upper part.

The fastening section is preferably cylindrical.

According to a further embodiment, the gas burner has a sealing device which can be arranged between the cooktop plate and the burner lower part.

The sealing device is preferably resiliently deformable. The sealing device is in particular configured to seal off the burner lower part from the cooktop plate.

According to a further embodiment, the receiving section of the burner upper part has a deformation section, which is configured to deform the sealing device in a resilient manner when the burner lower part is connected to the burner upper part.

Preferably, the deformation section has a semicircular end face, with which a compressive force can be exerted on the sealing device. This causes the sealing device to deform in a resilient manner.

According to a further embodiment, the deformation section is configured to deform the sealing device in such a way that the sealing device is at least partially in direct contact with the thermocouple and/or the igniting element.

When applying a compressive force to the sealing device, material of the sealing device is pressed against the thermocouple and/or the igniting element.

According to a further embodiment, the deformation section is configured to fix the thermocouple and/or the igniting element between the receiving section of the burner lower part and the receiving section of the burner upper part.

The receiving sections are embodied so as to correspond to the fastening section of the thermocouple and/or of the igniting element. Preferably, the receiving sections clamp around the fastening section in a form-fit manner.

According to a further embodiment, the deformation section is configured to deform the sealing device in such a way that the sealing device fits at least partially against the thermocouple and/or the igniting element.

A wobbling or vibrating of the thermocouple and/or of the igniting element can be reliably prevented as a result.

According to a further embodiment, the deformation section is semicircular.

In particular, the deformation section has the shape of a bisected tube. The deformation section may clamp around or surround the receiving section of the burner upper part at least partially.

According to a further embodiment, the deformation section extends out from a lower side of the burner upper part.

The deformation section is in particular embodied from the same piece of material as the burner upper part.

According to a further embodiment, the receiving section of the burner upper part is arranged within an outer diameter of the burner upper part.

This results in a compact design of the gas burner.

According to a further embodiment, the gas burner comprises a sealing ring which can be arranged between the burner upper part and the cooktop plate.

In particular, the sealing ring is manufactured from a resiliently deformable material.

According to a further embodiment, the sealing ring comprises a circumferential contact flange, which is configured to rest against the cooktop plate in a planar manner In particular, the thermocouple and/or the igniting element are arranged between the receiving section and the sealing ring.

According to a further embodiment, the burner upper part has a centering flange for centering the burner upper part on the sealing ring.

This simplifies the assembly of the burner upper part. This reduces the assembly complexity when assembling the gas burner.

Furthermore, a gas cooktop with a cooktop plate and a gas burner of this kind is proposed, which is fastened to the cooktop plate.

The gas cooktop can be a domestic appliance or a part of a domestic appliance.

According to a further embodiment, the cooktop plate is a glass-ceramic plate.

Further possible implementations of the gas burner and/or the gas cooktop also comprise combinations—not explicitly cited—of features or forms of embodiment described above or below in respect of the exemplary embodiments. Here the person skilled in the art will also add individual aspects as improvements or amendments to the respective basic form of the gas burner and/or the gas cooktop.

BRIEF DESCRIPTION OF THE DRAWINGS

Further advantageous embodiments and aspects of the gas burner and/or the gas cooktop form the subject matter of the subclaims and the exemplary embodiments of the gas burner and/or the gas cooktop described below. The gas burner and/or the gas cooktop are further explained in greater detail on the basis of the preferred embodiments with reference to the appended figures.

DETAILED DESCRIPTION OF EXEMPLARY EMBODIMENTS OF THE PRESENT INVENTION

Figure 1:
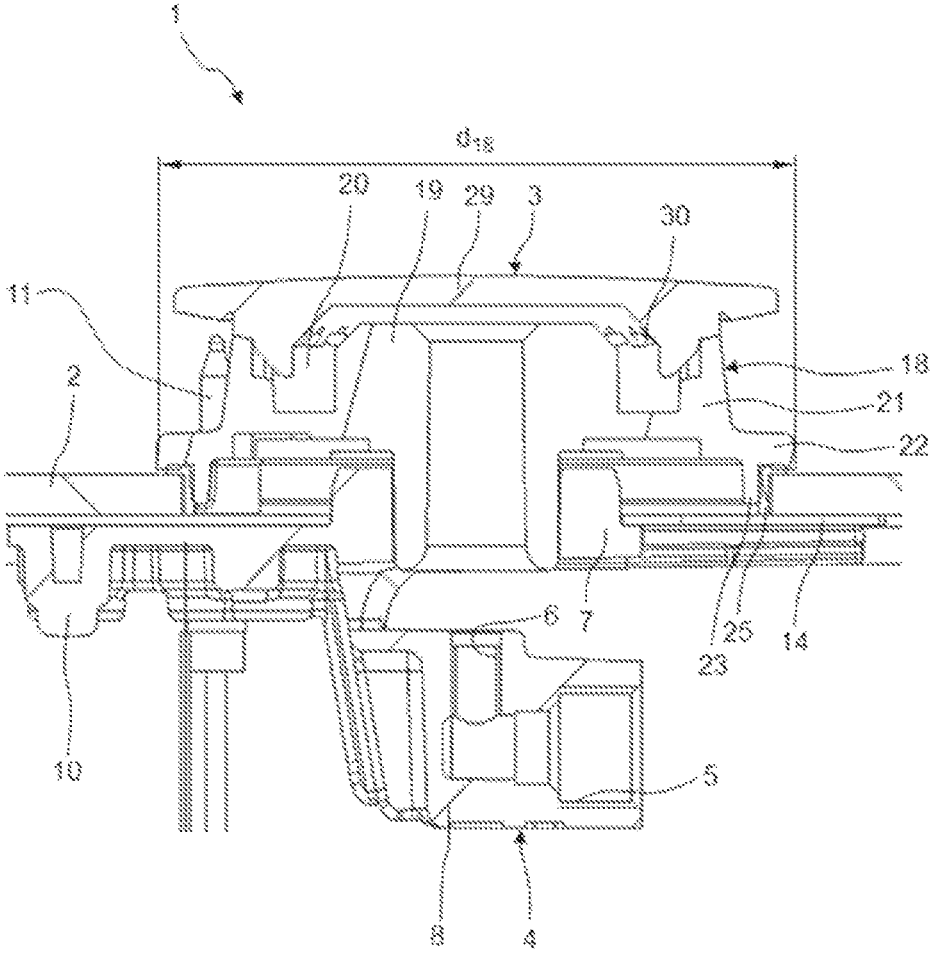
FIG. 1 shows a schematic sectional view of an embodiment of a gas cooktop.

Elements which are the same or function the same have been provided with the same reference characters in the figures, unless specified otherwise.

Figure 2:
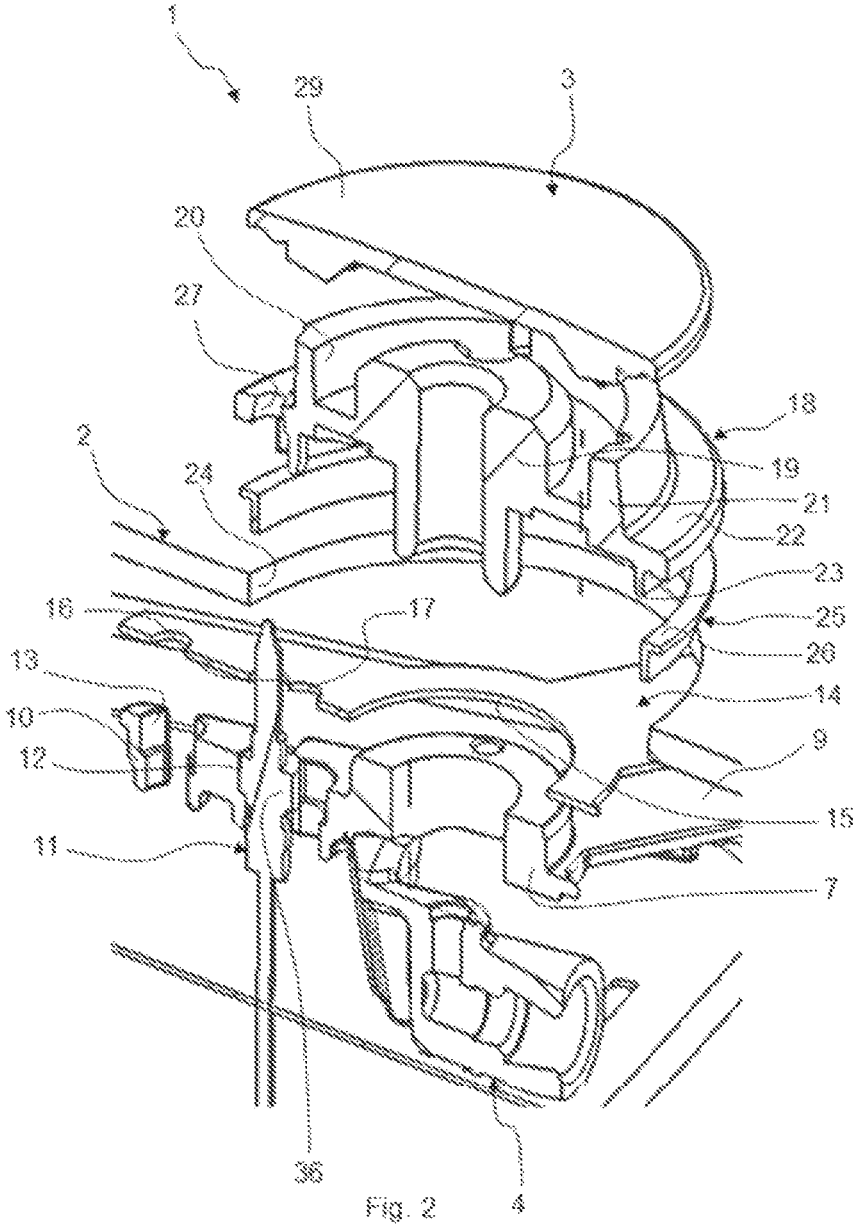
FIG. 2 shows a schematic exploded view of the gas cooktop according to FIG. 1.
Figure 3:
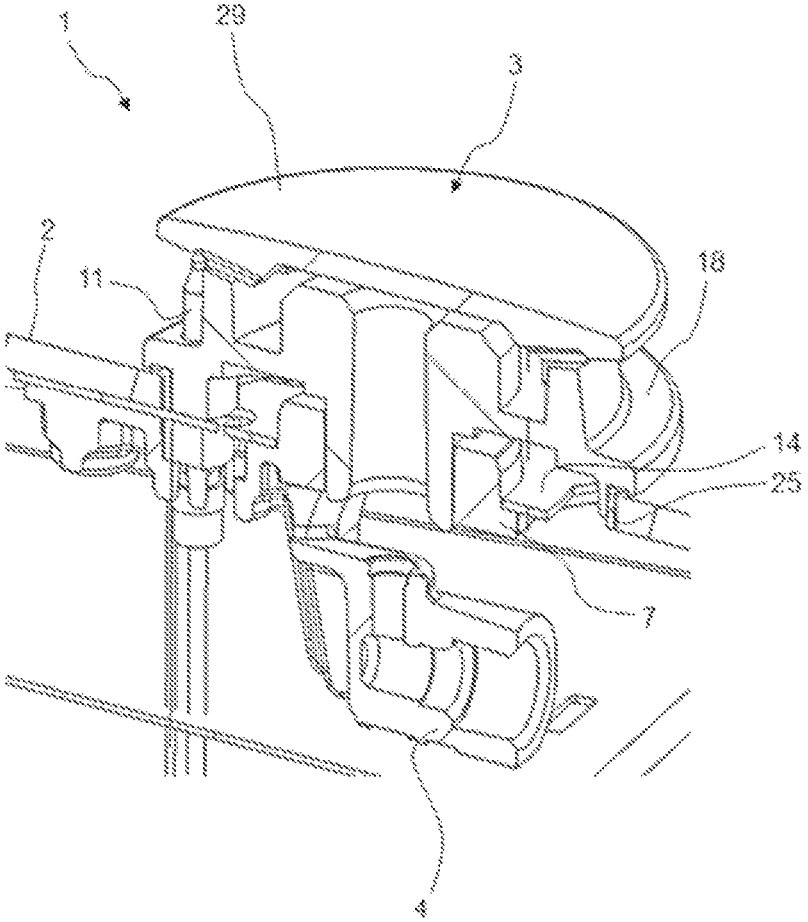
FIG. 3 shows a further schematic sectional view of the gas cooktop according to FIG. 1.
Figure 4:
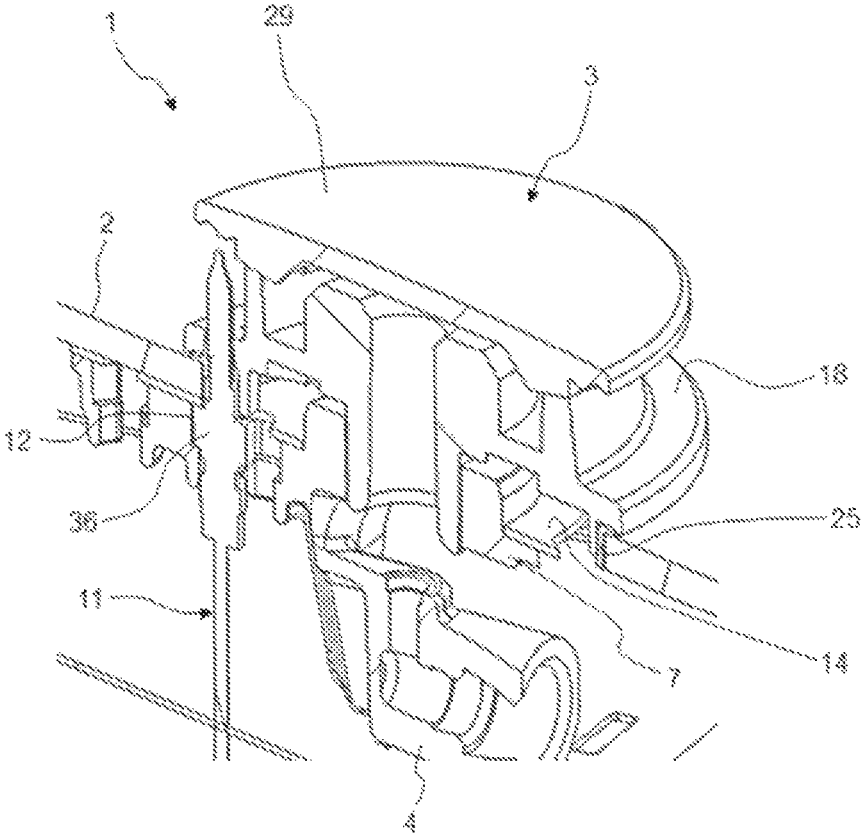
FIG. 4 shows a further schematic sectional view of the gas cooktop according to FIG. 1.

FIG. 1 shows a schematic sectional view of a gas cooktop 1. FIG. 2 shows a schematic exploded view of the gas cooktop 1. FIGS. 3 and 4 each show schematic sectional views of the gas cooktop 1. Reference is made below simultaneously to FIGS. 1 to 4.

The gas cooktop 1 comprises a cooktop plate 2. The cooktop plate 2 may be a glass-ceramic plate. The gas cooktop 1 furthermore comprises at least one gas burner 3. The gas cooktop 1 may have any number of gas burners 3. For example, the gas cooktop 1 may comprise four gas burners 3.

The gas burner 3 has a burner lower part 4, which can be arranged below the cooktop plate 2. The burner lower part 4 comprises a gas connection 5 for connecting the gas burner 3 to a gas supply line. The burner lower part 4 furthermore comprises a nozzle receptacle 6, in which a combustion gas nozzle can be received, in particular can be screwed in. The gas connection 5 and the nozzle receptacle 6 are preferably arranged perpendicularly to each other. Extending underneath out from an annular base section 7 of the burner lower part 4 is a connecting section 8, which has the gas connection 5 and the nozzle receptacle 6. The burner lower part 4 may, for example, be manufactured from a magnesium or aluminum alloy. For example, the burner lower part 4 may be a die-cast component.

Supporting arms 9 extend radially out from the annular base section 7. The supporting arms 9 are arranged in a V-shaped manner. For example, the burner lower part 4 may have two such supporting arms 9, with which the burner lower part 4 supports itself against the cooktop plate 2. Furthermore, a receiving arm 10 extends from the base section 7 to receive a thermocouple 11 and/or an igniting element (not shown). To this end, the receiving arm 10 has at least one receiving section 12 for receiving the thermocouple 11 and/or the igniting element. The receiving arm 10 furthermore comprises a cutout 13. The receiving arm 10 is dimensioned so as to be thicker than the supporting arms 9.

Arranged between the burner lower part 4 and the cooktop plate 2 is a resiliently deformable sealing device 14. The sealing device 14 has an opening 15 for the base section 7 of the burner lower part 4 and openings 16, 17 for the thermocouple 11 and/or the igniting element.

The gas burner 3 furthermore comprises a burner upper part 18 arranged above the cooktop plate 2. The burner upper part 18 may, for example, be manufactured from a magnesium or aluminum alloy. For example, the burner upper part 18 may be a die-cast component. The burner upper part 18 has a central base section 19, which is preferably embodied in a tubular manner and extends in, at least in sections, until the base section 7 of the burner lower part 4. There is provision for an annular distribution chamber 20 surrounding the base section 19. A combustion gas/air mixture is distributed evenly with the aid of the distribution chamber 20. The distribution chamber 20 is delimited on the outside by a circumferential wall 21.

An annular circumferential flange 22 connects to the circumferential wall 21. The burner upper part 18 and the flange 22 each have an outside diameter or diameter $d_{18}$. For different sizes of gas burner 3, the diameter $d_{18}$ is variable. Extending underneath out from the flange 22 is a centering flange 23. The base section 19 of the burner upper part 18 is guided through the cooktop 2 through a hole 24 provided in the cooktop plate 2. There is provision for a sealing ring 25 between the centering flange 23 and the hole 24. The burner upper part 18 can be centered on the sealing ring 25 with the aid of the centering flange 23. The sealing ring 25 is preferably resiliently deformable. The sealing ring 25 has a circumferential contact flange 26, which is configured to rest against the cooktop plate 2 in a planar manner.

Furthermore, the burner upper part 18 has at least one receiving section 27, 28 (FIG. 5, 6) for receiving the thermocouple 11 and/or the igniting element. The burner upper part 18 is connected to the burner lower part 4. For example, the burner upper part 18 and the burner lower part 4 are screwed together. The thermocouple 11 and/or the igniting element are simultaneously received in the receiving section 12 of the burner lower part 4 and the receiving section 27, 28 of the burner upper part 18. The thermocouple 11 and/or the igniting element are therefore arranged in a sandwich-like manner between the burner lower part 4 and the burner upper part 18.

The gas burner 3 furthermore comprises a burner lid 29 placed on the burner upper part 18. The burner lid 29 may, for example, be manufactured from a magnesium or aluminum alloy. For example, the burner lid 29 may be a die-cast component. There is provision on the burner lid 29 for radial gas outlet channels 30, from which the combustion gas/air mixture flows out from the distribution chamber 20. The thermocouple 11 furthermore comprises a cylindrical fastening section 36, which is arranged between the burner lower part 4 and the burner upper part 18. The fastening section 36 is simultaneously received in the receiving section 12 of the burner lower part 4 and the receiving section 27, 28 of the burner upper part 18.

Figure 5:
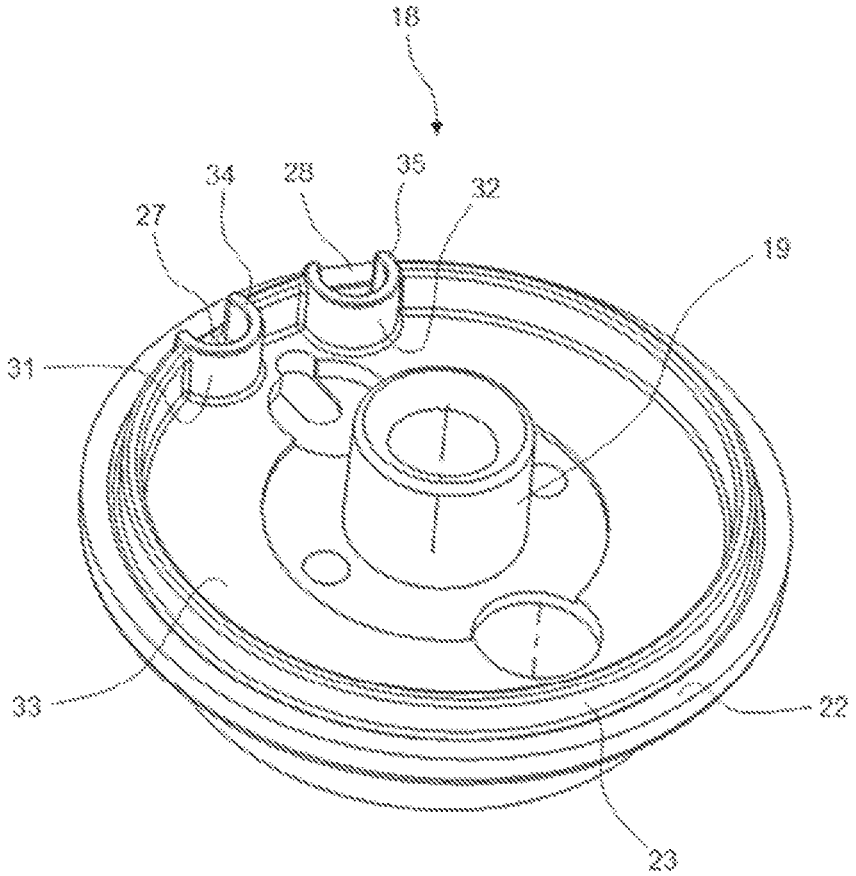
FIG. 5 shows a schematic perspective view of an embodiment of a burner upper part of a gas burner for the gas cooktop according to FIG. 1.
Figure 6:
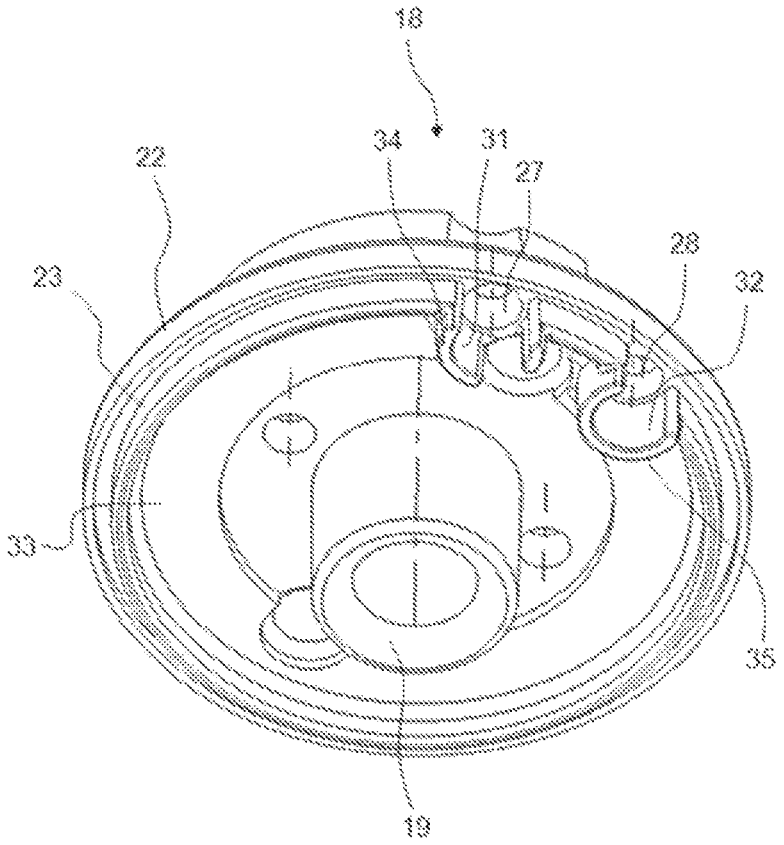
FIG. 6 shows a further schematic perspective view of the burner upper part according to FIG. 5.

As show in FIGS. 5 and 6, the burner upper part 18 has at least one deformation section 31, 32, which is configured to deform the sealing device 14 in a resilient manner when the burner lower part 4 is connected to the burner upper part 18. There is provision, for example, for two deformation sections 31, 32. The deformation sections 31, 32 are preferably tubular with a semicircular geometry. The receiving sections 27, 28 may be surrounded by the deformation section 31, 32, at least in sections. The deformation sections 31, 32 extend out from a lower side 33 of the burner upper part 18. The receiving sections 27, 28 are preferably arranged within the outer diameter $d_{18}$ of the burner upper part 18.

The deformation sections 31, 32 are configured to deform the sealing device 14 in a resilient manner when the burner lower part 4 is connected to the burner upper part 18. To this end, a compressive force is applied to the sealing device 14 with the aid of the deformation sections 31, 32. To this end, the deformation sections 31, 32 each have a semicircular end face 34, 35. As shown in FIG. 4, the sealing device 14 is deformed here in such a way that the sealing device 14 is at least partially in direct contact with the thermocouple 11 and/or the igniting element. Furthermore, the thermocouple 11 and/or the igniting element is also in direct contact with the sealing ring 25. As a result, a sandwich construction is achieved, in which the thermocouple 11 and/or the igniting element are arranged between the burner lower part 4 and the burner upper part 18 and are fixed with the aid of the sealing device 14. Here, the sealing device 14 fits at least partially against the thermocouple 11 and/or the igniting element.

As a result of the thermocouple 11 and/or the igniting element being arranged between the burner lower part 4 and the burner upper part 18, it is possible to dispense with additional parts for fastening the same to the gas burner 3. This enables the complexity of the gas burner 3 to be reduced. The costs for manufacture and assembly of the gas burner 3 are reduced. The assembly of the burner upper part 18 on the cooktop plate 2 is simplified with the aid of the centering flange 23. The aesthetics of the gas burner 3 are improved by the receiving sections 27, 28 being arranged within the diameter $d_{18}$. Furthermore, the gas burner 3 can also have a more compact construction as a result.

The invention claimed is:

1. A gas burner for a gas cooktop, comprising:

a burner lower part configured for arrangement below a cooktop plate of the gas cooktop, a burner upper part configured for arrangement above the cooktop plate and connected to the burner lower part, a thermocouple and/or an igniting element, which is received in a receiving section of the burner lower part and a receiving section of the burner upper part, and a sealing device configured for arrangement between the cooktop plate and the burner lower part, wherein the receiving section of the burner upper part has a deformation section having a hollow shape that extends downward from a lower side of the burner upper part and is configured to contact the sealing device and to deform the sealing device in a resilient manner between the receiving section of the burner upper part and the burner lower part when the burner lower part is connected to the burner upper part.

2. The gas burner of claim 1, wherein the thermocouple and/or the igniting element includes a fastening section which is arranged between the burner lower part and the burner upper part.

3. The gas burner of claim 2, wherein the fastening section includes a central increased diameter section that is larger than upper and lower sections of the thermocouple and/or igniting element, wherein during assembly the central increased diameter section is sandwiched between the burner lower part and the burner upper part whilst the upper section passes through the receiving section of the burner upper part and the lower section passes through the receiving section of the burner lower part.

4. The gas burner of claim 1, wherein the deformation section is configured to deform the sealing device in such a way that the sealing device is at least partially in direct contact with the thermocouple and/or the igniting element.

5. The gas burner of claim 1, wherein the deformation section is configured to fix the thermocouple and/or the igniting element between the receiving section of the burner lower part and the receiving section of the burner upper part.

6. The gas burner of claim 1, wherein the deformation section is configured to deform the sealing device in such a way that the sealing device fits at least partially against the thermocouple and/or the igniting element.

7. The gas burner of claim 1, wherein the deformation section is semicircular.

8. The gas burner of claim 7, wherein the deformation section has a semicircular C-shaped end face that opens toward a perimeter of the burner upper part.

9. The gas burner of claim 8, wherein the burner upper part includes a downward extending centering flange configured to protrude within a hole in the cooktop plate, and wherein open longitudinal ends of the C-shaped end face terminate substantially at the centering flange.

10. The gas burner of claim 1, wherein the receiving section of the burner upper part is arranged within an outer diameter of the burner upper part.

11. The gas burner of claim 1, further comprising a sealing ring configured for arrangement between the burner upper part and the cooktop plate.

12. The gas burner of claim 11, wherein the sealing ring comprises a circumferential contact flange, which is configured to rest against the cooktop plate in a planar manner.

13. The gas burner of claim 11, wherein the burner upper part has a centering flange for centering the burner upper part on the sealing ring.

14. A gas cooktop, comprising:

a cooktop plate; and a gas burner fastened to the cooktop plate, said gas burner comprising a burner lower part configured for arrangement below a cooktop plate of the gas cooktop, a burner upper part configured for arrangement above the cooktop plate and connected to the burner lower part, a thermocouple and/or an igniting element, which is simultaneously received in a receiving section of the burner lower part and a receiving section of the burner upper part, and a sealing device configured for arrangement between the cooktop plate and the burner lower part, wherein the receiving section of the burner upper part has a deformation section having a hollow shape that extends downward from a lower side of the burner upper part and is configured to contact the sealing device and to deform the sealing device in a resilient manner between the receiving section of the burner upper part and the burner lower part when the burner lower part is connected to the burner upper part.

15. The gas cooktop of claim 14, wherein the cooktop plate is a glass-ceramic plate.

* * * * *